US010475408B2

(12) United States Patent
Li

(10) Patent No.: US 10,475,408 B2
(45) Date of Patent: Nov. 12, 2019

(54) LIQUID CRYSTAL DISPLAY PANEL WITH A POLARITY REVERSION AND GATE DRIVING CIRCUIT THEREOF

(71) Applicant: Shenzhen China Star Optoelectronics Technology Co., Ltd., Shenzhen, Guangdong (CN)

(72) Inventor: Wenying Li, Guangdong (CN)

(73) Assignee: Shenzhen China Star Optoelectronics Semiconductor Display Technology Co., Ltd, Shenzhen, Guangdong (CN)

( * ) Notice: Subject to any disclaimer, the term of this patent is extended or adjusted under 35 U.S.C. 154(b) by 58 days.

(21) Appl. No.: 15/742,504

(22) PCT Filed: Dec. 20, 2017

(86) PCT No.: PCT/CN2017/117313

§ 371 (c)(1),
(2) Date: Jan. 6, 2018

(87) PCT Pub. No.: WO2019/090908

PCT Pub. Date: May 16, 2019

(65) Prior Publication Data

US 2019/0139507 A1 May 9, 2019

(30) Foreign Application Priority Data

Nov. 7, 2017 (CN) ..... 2017 1 1088166

(51) Int. Cl.
*G09G 3/36* (2006.01)

(52) U.S. Cl.
CPC ..... *G09G 3/3677* (2013.01)

(58) Field of Classification Search
CPC ..... G09G 3/3677
See application file for complete search history.

(56) References Cited

U.S. PATENT DOCUMENTS 7,154,464 B2 12/2006 Lee et al.
8,717,271 B2 * 5/2014 Kwon ..... G09G 3/3614 345/209
2004/0217935 A1 * 11/2004 Jeon ..... G09G 3/3648 345/100
2007/0040795 A1 2/2007 Lee et al.
(Continued)

FOREIGN PATENT DOCUMENTS

CN 101122697 A 2/2008
CN 101676985 A 3/2010
CN 206946910 U 1/2018

*Primary Examiner* — Kwang-Su Yang
(74) *Attorney, Agent, or Firm* — Andrew C. Cheng

(57) ABSTRACT

Disclosed are a liquid crystal display panel and a gate driving circuit thereof. The liquid crystal display panel includes a plurality of pixel units arranged in a matrix, a plurality of scan lines, a gate driving circuit, a plurality of data lines and a data driving circuit. Every two scan lines are corresponded to the pixel units in the same column and alternatively connected to the pixel units in the same column. Each data line is connected to the pixel units in the two rows. The driving abilities of the gate driving signals provided to the two scan lines corresponding to the pixel units in the same column are different. In this manner, the liquid crystal display panel can have less brightness variation and thus have a better display performance.

15 Claims, 4 Drawing Sheets

(56) References Cited

U.S. PATENT DOCUMENTS

| | | | | |
|---|---|---|---|---|
| 2008/0218502 | A1* | 9/2008 | Lee | G09G 3/3674 345/208 |
| 2012/0075277 | A1* | 3/2012 | Hirayama | G09G 3/3614 345/209 |
| 2013/0057598 | A1* | 3/2013 | Iwamoto | G02F 1/136286 345/690 |
| 2014/0225819 | A1* | 8/2014 | Onuma | G09G 3/3648 345/88 |

* cited by examiner

LIQUID CRYSTAL DISPLAY PANEL WITH A POLARITY REVERSION AND GATE DRIVING CIRCUIT THEREOF

FIELD OF THE DISCLOSURE

The disclosure relates to a liquid crystal display panel and a gate driving circuit thereof, and more particularly to a liquid crystal display panel and a gate driving circuit thereof that can reduce the brightness variation and thus have a better performance.

BACKGROUND

The liquid crystal display panel is widely is used in many kinds of electronic devices because it has a high display quality, an acceptable price and is portable. With the development of the display technology, a new driving method will be required to have a low cost. To have a low cost, the number of the data lines will be decreased. Also, the Gate driver on Array (GOA) is used at the gates. For the liquid crystal display panel, if the liquid molecule is always driven by a positive voltage or a negative voltage, the liquid molecule will be damaged. Thus, to avoid the liquid molecule damaging by the driving voltage, the liquid molecule should be driven alternately by a positive voltage and a negative voltage. Usually, the polarity reversions include the frame inversion, the column inversion, the row inversion and the dot inversion. The dot inversion is often used because it has the best image performance. However, the pixel units will have a low charging efficiency due to a polarity reversion occurs when charging. If no polarity reversion occurs when charging, the pixel units will have a high charging efficiency. The differences among the charging efficiencies cause dark lines and light lines shown on liquid crystal display panel, which lowers the performance of the display panel and causes bad user experiences.

SUMMARY

To solve the above technical problems, the disclosure provides a liquid crystal display panel and a gate driving circuit thereof. The brightness variation of the liquid crystal display can be reduced due to its gate driving circuit, and thus the liquid crystal display has a better display performance.

The liquid crystal display panel provided by the disclosure includes a plurality of pixel units arranged in a matrix, a plurality of scan lines, a gate driving circuit, a plurality of data lines and a data driving circuit. Every two scan lines are corresponded to the pixel units in the same column and alternatively connected to the pixel units in the same column. The gate driving circuit is configured to provide a gate driving signal sequentially to each scan line to turn on the pixel units connected with each scan line. The data lines are configured respectively between the pixel units in every two rows, and each data line is connected to the pixel units in the two rows. The data driving circuit is configured to provide a data driving signal to each data line by reversing the polarity of the data driving signal to charge the turned-on pixel units connected with each data line. The driving abilities of the gate driving signals provided to the two scan lines corresponding to the pixel units in the same column are different such that the charging variation caused by reversing the polarity of the data driving signal is cancelled.

The gate driving circuit provided by the disclosure includes a first driving stage and a second driving stage. The first driving stage receives a first clock signal and accordingly outputs a first gate driving signal. The second driving stage, receives a second clock signal and accordingly outputs a second gate driving signal. The driving abilities of the first gate driving signal and the second gate driving signal are different due to the first clock signal and the second clock signal.

In this disclosure, the charging variation caused by reversing the polarity of the data driving signal can be cancelled, because, in the liquid crystal display panel, the driving abilities of the gate driving signals provided to the two scan lines corresponding to the pixel units in the same column are different.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
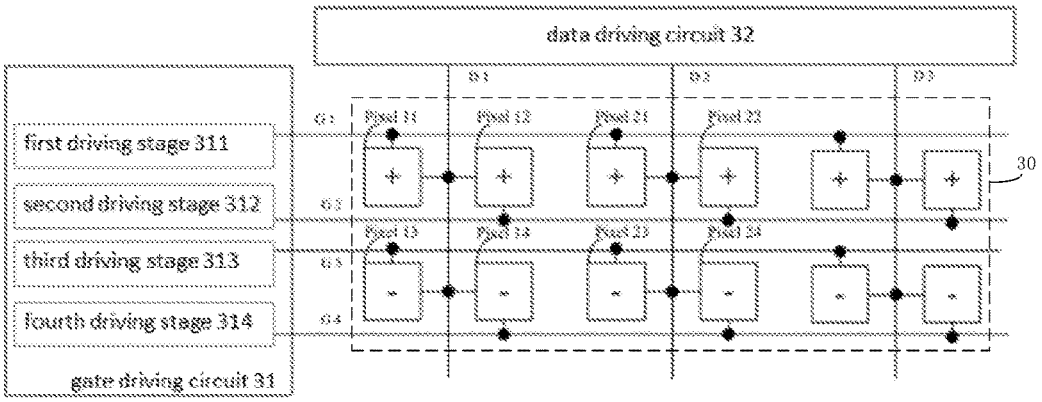
FIG. 1 is a structural schematic diagram of a liquid crystal display panel according to the first embodiment of the disclosure.

The specific structural and functional details disclosed herein are only representative and are intended for describing exemplary embodiments of the disclosure. However, the disclosure can be embodied in many forms of substitution, and should not be interpreted as merely limited to the embodiments described herein.

In the description of the disclosure, terms such as "center", "transverse", "above", "below", "left", "right", "vertical", "horizontal", "top", "bottom", "inside", "outside", etc. for indicating orientations or positional relationships refer to orientations or positional relationships as shown in the drawings; the terms are for the purpose of illustrating the disclosure and simplifying the description rather than indicating or implying the device or element must have a certain orientation and be structured or operated by the certain orientation, and therefore cannot be regarded as limitation with respect to the disclosure. Moreover, terms such as "first" and "second" are merely for the purpose of illustration and cannot be understood as indicating or implying the relative importance or implicitly indicating the number of the technical feature. Therefore, features defined by "first" and "second" can explicitly or implicitly include one or more the features. In the description of the disclosure, unless otherwise indicated, the meaning of "plural" is two or more than two. In addition, the term "comprise" and any variations thereof are meant to cover a non-exclusive inclusion.

In the description of the disclosure, is should be noted that, unless otherwise clearly stated and limited, terms "mounted", "connected with" and "connected to" should be understood broadly, for instance, can be a fixed connection, a detachable connection or an integral connection; can be a mechanical connection, can also be an electrical connection; can be a direct connection, can also be an indirect connection by an intermediary, can be an internal communication of two elements. A person skilled in the art can understand concrete meanings of the terms in the disclosure as per specific circumstances.

The terms used herein are only for illustrating concrete embodiments rather than limiting the exemplary embodiments. Unless otherwise indicated in the content, singular forms "a" and "an" also include plural. Moreover, the terms "comprise" and/or "include" define the existence of described features, integers, steps, operations, units and/or components, but do not exclude the existence or addition of one or more other features, integers, steps, operations, units, components and/or combinations thereof.

The disclosure will be further described in detail with reference to accompanying drawings and preferred embodiments as follows.

Referring to FIG. 1, a structural schematic diagram of a liquid crystal display panel according to the first embodiment of the disclosure is shown. The liquid crystal display panel 30 includes a plurality of pixel units, such as the Pixel 11, the Pixel 12, the Pixel 13, the Pixel 14, the Pixel 21, the Pixel 22, the Pixel 23 and the Pixel 24. These pixel units are arranged in a matrix. The gate driving circuit 31 is configured at one side of the liquid crystal display panel 30, and includes a first driving stage 311, a second driving stage 312, a third driving stage 313 and a fourth driving stage 314. The gate driving circuit 31 is connected to the scan lines, to provide a gate driving signal sequentially to each scan line, such that the pixel units connected with each scan line can be sequentially turned on. The scan line G1 is connected to the first driving stage 311, the scan line G1 2 is connected to the second driving stage 312, the scan line G3 is connected to the third driving stage 313, and the scan line G4 is connected to the fourth driving stage 314.

Every two scan lines are corresponded to the pixel units in the same column, and are alternatively connected to the pixel units in the same column. For example, the scan line G1 and the scan line G2 are corresponded to the Pixel 11, the Pixel 12, the Pixel 21 and the Pixel 22. The scan line G1 is connected to the Pixel 11, and the scan line G2 is connected to the Pixel 12, wherein the Pixel 11 and the Pixel 12 are adjacent and in the same column of the matrix. The scan line G1 is connected to the Pixel 21, wherein the Pixel 21 and the Pixel 12 are adjacent and in the same column of the matrix, and the scan line G2 is connected to the Pixel 22, wherein the Pixel 22 and the Pixel 21 are adjacent and in the same column of the matrix.

The data driving circuit 32 is configured at one side of the liquid crystal display panel 30 and is connected to the data lines, to charge the turned-on pixel units connected with each data line. The data lines are configured respectively between the pixel units in every two rows, and each data line is connected to the pixel units in the two rows. For example, the data line D1 is connected to the pixel units in the row wherein the Pixel 11 and the Pixel 13 are, and is simultaneously connected to the pixel units in the row wherein the Pixel 12 and the Pixel 14 are.

The scan line G1, the scan line G2, the scan line G3 and the scan line G4 are respectively perpendicular to the data line D1, the data line D2 and the data line D3. In other embodiments, the scan line G1, the scan line G2, the scan line G3 and the scan line G4 can be not perpendicular to the data line D1, the data line D2 and the data line D3, as long as there is an included angle between the scan line G1, the scan line G2, the scan line G3 and the scan line G4, and the data line D1, the data line D2 and the data line D3, wherein the degree of the included angle is not restricted.

Figure 2:
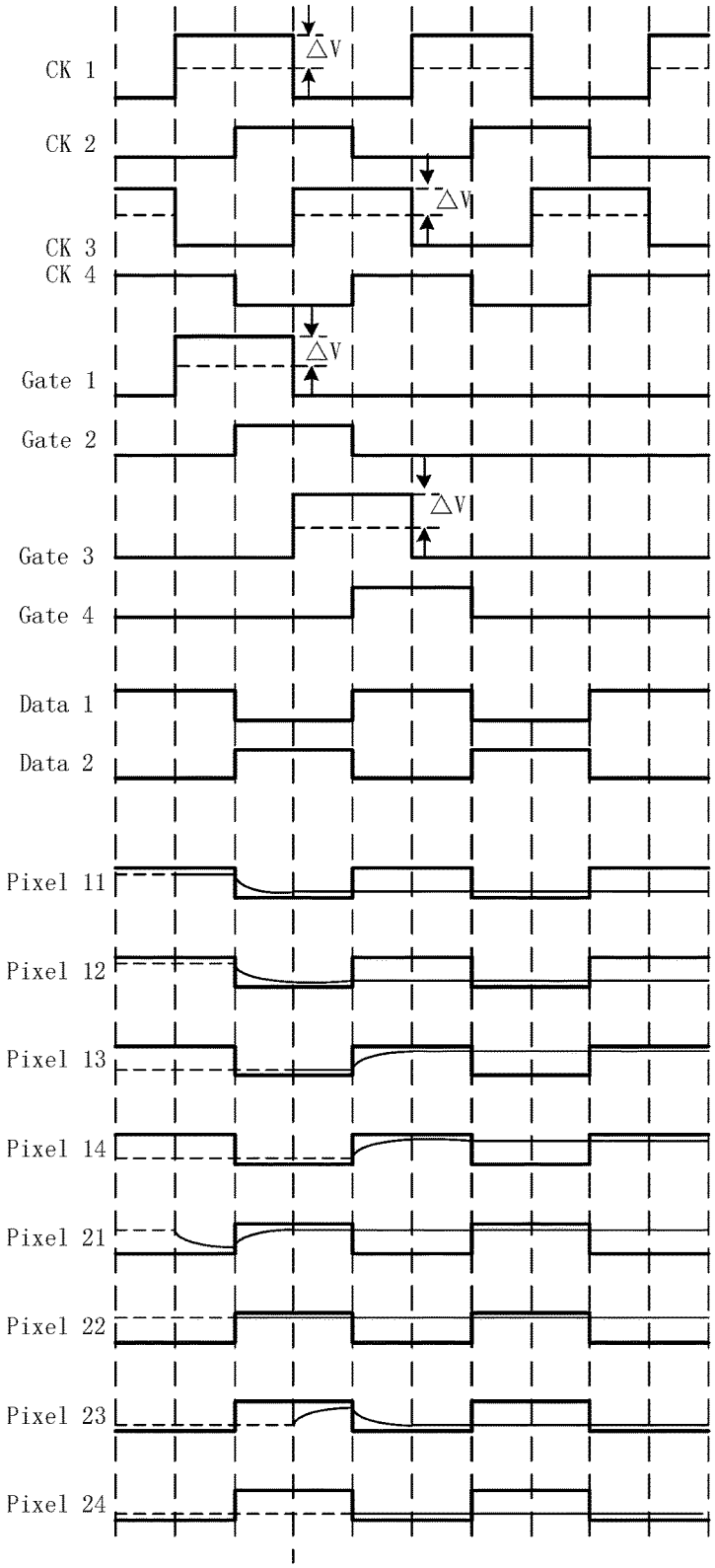
FIG. 2 is a schematic diagram of a clock signal, a gate driving signal and the charging voltage of the pixel units according to the first embodiment of the disclosure.

Referring to FIG. 2, a schematic diagram of a clock signal, a gate driving signal and the charging voltage of the pixel units according to the first embodiment of the disclosure is shown. In FIG. 2, the signal CK1 is the first clock signal received by the first driving stage 311, the signal CK2 is the second clock signal received by the second driving stage 312, the signal CK3 is the third clock signal received by the third driving stage 313, and the signal CK4 is the fourth clock signal received by the fourth driving stage 314. The periods of the signal CK1, the signal CK2, the signal CK3 and the signal CK4 are equal. The phase difference between the signal CK1 and the signal CK2, the phase difference between the signal CK2 and the signal CK3 and the phase difference between the signal CK3 and the signal CK4 are a quarter of the period. The signal Gate 1 is the first gate driving signal outputted by the first driving stage 311 to the scan line G1 according to the signal CK1. The signal Gate 2 is the second gate driving signal outputted by the second driving stage 312 to the scan line G2 according to the signal CK2. The signal Gate 3 is the third gate driving signal outputted by the third driving stage 313 to the scan line G3 according to the signal CK3. The signal Gate 4 is the fourth gate driving signal outputted by the fourth driving stage 314 to the scan line G4 according to the signal CK4. The periods of the signal Gate 1, the signal Gate 2, the signal Gate 3 and the signal Gate 4 are equal. The phase difference between the signal Gate 1 and the signal Gate 2, the phase difference between the signal Gate 2 and the signal Gate 3 and the phase difference between the signal Gate 3 and the signal Gate 4 are a quarter of the period. The Pixel 11 connected with the scan line G1 is driven by the signal Gate 1, the Pixel 12 connected with the scan line G2 is driven by the signal Gate 2, the Pixel 13 connected with the scan line G3 is driven by the signal Gate 3, and the Pixel 14 connected with the scan line G4 is driven by the signal Gate 4.

The pulse heights of the signal CK1 and the signal CK3 are equal, the pulse heights of the signal CK2 and the signal CK4 are equal, and the pulse heights of the signal CK1 and the signal CK3 are larger than the pulse heights of the signal CK2 and the signal CK4 by $\Delta V$. The pulse height of the signal Gate 1 outputted according to the signal CK1 and the pulse height of the signal Gate 3 outputted according to the signal CK3 are equal, and the pulse height of the signal Gate 2 outputted according to the signal CK2 and the pulse height of the signal Gate 4 outputted according to the signal CK4 are equal. Thus, the pulse heights of the signal Gate 1 and the signal Gate 3 are larger than the pulse heights of the signal Gate 2 and the signal Gate 4 by $\Delta V$. The larger the pulse height of the gate driving signal is, the better the pixel units can be driven and the higher the charging efficiency of the pixel units will be. Therefore, the charging efficiencies of the Pixel 11 and the Pixel 13 respectively driven by the signal Gate 1 and signal Gate 3 are higher than the charging efficiencies of the Pixel 12 and the Pixel 14 respectively driven by the signal Gate 2 and signal Gate 4.

In this embodiment, the pulse heights of the signal CK1 and the signal CK3 are enlarged so that the pulse heights of the signal CK1 and the signal CK3 are larger than the pulse heights of the signal CK2 and the signal CK4. In other embodiments, to make the pulse heights of the signal CK1 and the signal CK3 larger than the pulse heights of the signal CK2 and the signal CK4, the pulse heights of the signal CK2 and the signal CK4 can be shrunk, or the pulse heights of the signal CK1 and the signal CK3 can be enlarged and at the same time the pulse heights of the signal CK2 and the signal CK4 can be shrunk.

The signal Data 1 is the data driving signal outputted by the data driving circuit 32 to the data line D1, and the signal Data 2 is the data driving signal outputted by the data driving circuit 32 to the data line D2. The period of the signal Data 1 and the period of the signal Data 2 are equal, but the polarity of the signal Data 1 and the polarity of the signal Data 2 are opposite.

As shown in FIG. 2, the Pixel 11 is driven by the signal Gate 1 and thus turned on before the polarity of the signal Data 1 is reversed. When the Pixel 11 is turned on, due to the signal Data 1, the Pixel 11 receives a signal at high level for charging within the former quarter of the period, and receives a signal at low level for charging within the later quarter of the period. Thus, during the time when the Pixel 11 is charged, the polarity of the Pixel 11 is reversed such that the Pixel 11 is not fully charged. The Pixel 12 is driven by the signal Gate 2 and thus turned on after the polarity of the signal Data 1 is reversed. During the time when the Pixel 12 is charged, the Pixel 12 always receives a signal at low level for charging, so the polarity of the Pixel 12 will not be reversed and thus the Pixel 12 is fully charged.

However, the charging efficiency of the Pixel 11 driven by the signal Gate 1 is better than the charging efficiency of the Pixel 12 driven by the signal Gate 2, and thus difference between the charging amount of the Pixel 11 and the charging amount of the Pixel 12 is small even though the polarity of the Pixel 11 is reversed during the time when the Pixel 11 is charged.

Likewise, the Pixel 13 is driven by the signal Gate 3 and thus turned on before the polarity of the signal Data 1 is reversed. When the Pixel 13 is turned on, due to the signal Data 1, the Pixel 13 receives a signal at low level for charging within the former quarter of the period, and receives a signal at high level for charging within the later quarter of the period. Thus, during the time when the Pixel 13 is charged, the polarity of the Pixel 13 is reversed such that the Pixel 13 is not fully charged. The Pixel 14 is driven by the signal Gate 4 and thus turned on after the polarity of the signal Data 1 is reversed. During the time when the Pixel 14 is charged, the Pixel 14 always receives a signal at high level for charging, so the polarity of the Pixel 14 will not be reversed and thus the Pixel 14 is fully charged.

However, the charging efficiency of the Pixel 13 driven by the signal Gate 3 is better than the charging efficiency of the Pixel 14 driven by the signal Gate 4, and thus difference between the charging amount of the Pixel 13 and the charging amount of the Pixel 14 is small even though the polarity of the Pixel 13 is reversed during the time when the Pixel 13 is charged.

The working principles relevant to how the Pixel 21, the Pixel 22, the Pixel 23 and the Pixel 24 are charged are similar to the above working principles relevant to how the Pixel 11, the Pixel 12, the Pixel 13 and the Pixel 14 are charged, and thus the repeated descriptions are omitted herein.

In other embodiments, the gate driving circuit 31 can have six, eight or more driving stages as long as the number of the driving stages is an even.

According to the above, in this embodiment, the charging efficiency of the pixel units can be raised by increasing the voltage of the gate driving signal of those pixel units of which the polarity will be revered during their charging process. Thus, a difference between the charging amount of those pixel units of which the polarity will be revered during their charging process and the charging amount of those pixel units of which the polarity will not be revered during their charging process will be small, such that the brightness variation of the liquid crystal display can be reduced and thus the liquid crystal display can have a better display performance.

Figure 3:
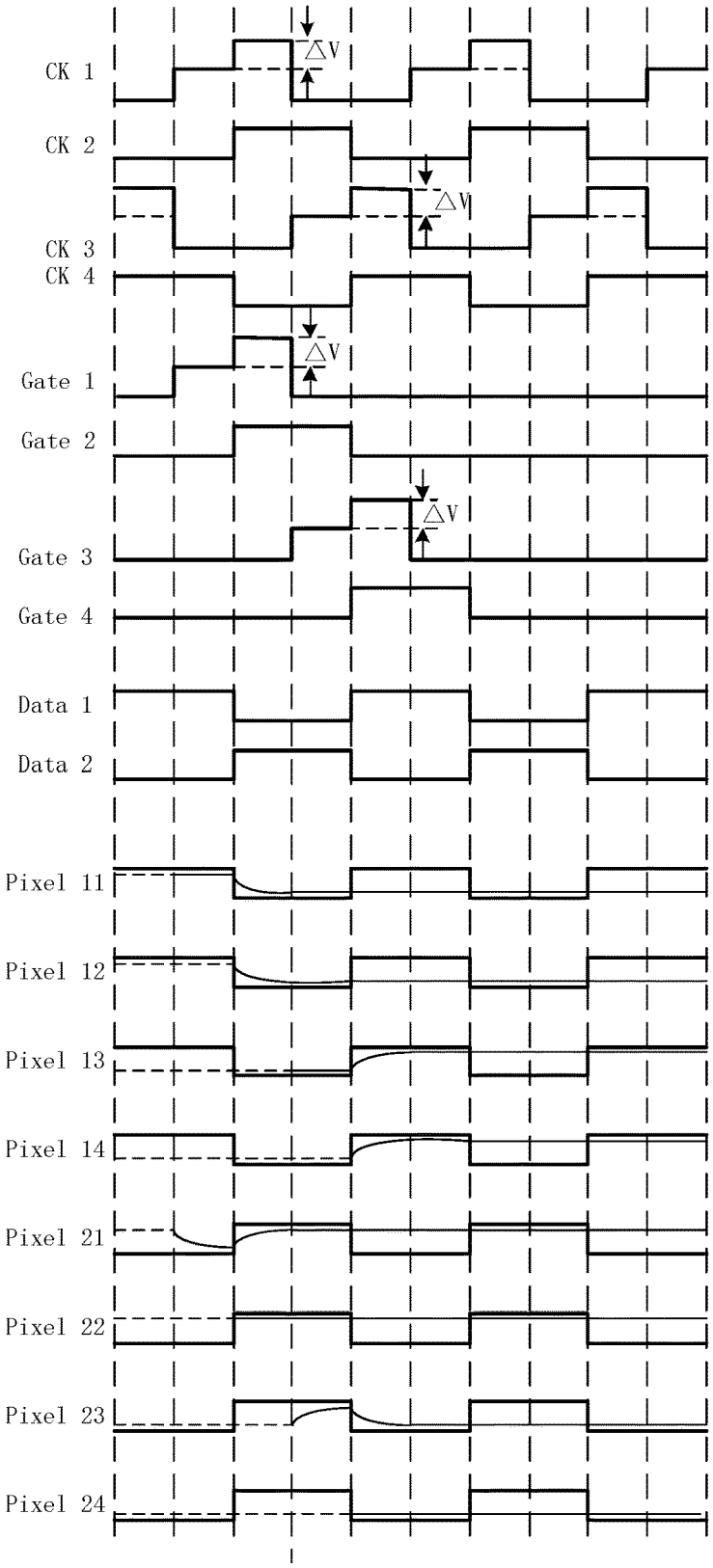
FIG. 3 is a schematic diagram of a clock signal, a gate driving signal and the charging voltage of the pixel units according to the second embodiment of the disclosure.

In conjunction with FIG. 1 and FIG. 3, FIG. 3 shows a schematic diagram of a clock signal, a gate driving signal and the charging voltage of the pixel units according to the second embodiment of the disclosure. In FIG. 3, the signal CK1 is the first clock signal received by the first driving stage 311, the signal CK2 is the second clock signal received by the second driving stage 312, the signal CK3 is the third clock signal received by the third driving stage 313, and the signal CK4 is the fourth clock signal received by the fourth driving stage 314. The periods of the signal CK1, the signal CK2, the signal CK3 and the signal CK4 are equal. The phase difference between the signal CK1 and the signal CK2, the phase difference between the signal CK2 and the signal CK3 and the phase difference between the signal CK3 and the signal CK4 are a quarter of the period. The signal Gate 1 is the first gate driving signal outputted by the first driving stage 311 to the scan line G1 according to the signal CK1. The signal Gate 2 is the second gate driving signal outputted by the second driving stage 312 to the scan line G2 according to the signal CK2. The signal Gate 3 is the third gate driving signal outputted by the third driving stage 313 to the scan line G3 according to the signal CK3. The signal Gate 4 is the fourth gate driving signal outputted by the fourth driving stage 314 to the scan line G4 according to the signal CK4. The periods of the signal Gate 1, the signal Gate 2, the signal Gate 3 and the signal Gate 4 are equal. The phase difference between the signal Gate 1 and the signal Gate 2, the phase difference between the signal Gate 2 and the signal Gate 3 and the phase difference between the signal Gate 3 and the signal Gate 4 are a quarter of the period. The Pixel 11 connected with the scan line G1 is driven by the signal Gate 1, the Pixel 12 connected with the scan line G2 is driven by the signal Gate 2, the Pixel 13 connected with the scan line G3 is driven by the signal Gate 3, and the Pixel 14 connected with the scan line G4 is driven by the signal Gate 4.

The pulse heights of the signal CK1 and the signal CK3 are equal, the pulse heights of the signal CK2 and the signal CK4 are equal, and the pulse heights of the last half of the signal CK1 and the signal CK3 are larger than the pulse heights of the signal CK2 and the signal CK4 by ΔV. The pulse height of the signal Gate 1 outputted according to the signal CK1 and the pulse height of the signal Gate 3 outputted according to the signal CK3 are equal, and the pulse height of the signal Gate 2 outputted according to the signal CK2 and the pulse height of the signal Gate 4 outputted according to the signal CK4 are equal. Thus, the pulse heights of the last half of the signal Gate 1 and the signal Gate 3 are larger than the pulse heights of the signal Gate 2 and the signal Gate 4 by ΔV. The larger the pulse height of the gate driving signal is, the better the pixel units can be driven and the higher the charging efficiency of the pixel units will be. Therefore, the charging efficiencies of the Pixel 11 and the Pixel 13 respectively driven by the signal Gate 1 and signal Gate 3 are higher than the charging efficiencies of the Pixel 12 and the Pixel 14 respectively driven by the signal Gate 2 and signal Gate 4.

In this embodiment, the pulse heights of the last half of the signal CK1 and the signal CK3 are enlarged so that the pulse heights of the signal CK1 and the signal CK3 are larger than the pulse heights of the signal CK2 and the signal CK4. In other embodiments, to make the pulse heights of the signal CK1 and the signal CK3 larger than the pulse heights of the signal CK2 and the signal CK4, the pulse heights of the signal CK2 and the signal CK4 can be shrunk, or the pulse heights of the last half of the signal CK1 and the signal CK3 can be enlarged and at the same time the pulse heights of the signal CK2 and the signal CK4 can be shrunk.

In other embodiments, the duty cycle of the signal CK1 and the duty cycle of the signal CK3 are arbitrary, and they are not restricted by 50% shown in FIG. 3.

The signal Data 1 is the data driving signal outputted by the data driving circuit 32 to the data line D1, and the signal Data 2 is the data driving signal outputted by the data driving circuit 32 to the data line D2. The period of the signal Data 1 and the period of the signal Data 2 are equal, but the polarity of the signal Data 1 and the polarity of the signal Data 2 are opposite.

As shown in FIG. 3, the Pixel 11 is driven by the signal Gate 1 and thus turned on before the polarity of the signal Data 1 is reversed. When the Pixel 11 is turned on, due to the signal Data 1, the Pixel 11 receives a signal at high level for charging within the former quarter of the period, and receives a signal at low level for charging within the later quarter of the period. Thus, during the time when the Pixel 11 is charged, the polarity of the Pixel 11 is reversed such that the Pixel 11 is not fully charged. The Pixel 12 is driven by the signal Gate 2 and thus turned on after the polarity of the signal Data 1 is reversed. During the time when the Pixel 12 is charged, the Pixel 12 always receives a signal at low level for charging, so the polarity of the Pixel 12 will not be reversed and thus the Pixel 12 is fully charged.

However, the charging efficiency of the Pixel 11 driven by the signal Gate 1 is better than the charging efficiency of the Pixel 12 driven by the signal Gate 2, and thus difference between the charging amount of the Pixel 11 and the charging amount of the Pixel 12 is small even though the polarity of the Pixel 11 is reversed during the time when the Pixel 11 is charged.

Likewise, the Pixel 13 is driven by the signal Gate 3 and thus turned on before the polarity of the signal Data 1 is reversed. When the Pixel 13 is turned on, due to the signal Data 1, the Pixel 13 receives a signal at low level for charging within the former quarter of the period, and receives a signal at high level for charging within the later quarter of the period. Thus, during the time when the Pixel 13 is charged, the polarity of the Pixel 13 is reversed such that the Pixel 13 is not fully charged. The Pixel 14 is driven by the signal Gate 4 and thus turned on after the polarity of the signal Data 1 is reversed. During the time when the Pixel 14 is charged, the Pixel 14 always receives a signal at high level for charging, so the polarity of the Pixel 14 will not be reversed and thus the Pixel 14 is fully charged.

However, the charging efficiency of the Pixel 13 driven by the signal Gate 3 is better than the charging efficiency of the Pixel 14 driven by the signal Gate 4, and thus difference between the charging amount of the Pixel 13 and the charging amount of the Pixel 14 is small even though the polarity of the Pixel 13 is reversed during the time when the Pixel 13 is charged.

The working principles relevant to how the Pixel 21, the Pixel 22, the Pixel 23 and the Pixel 24 are charged are similar to the above working principles relevant to how the Pixel 11, the Pixel 12, the Pixel 13 and the Pixel 14 are charged, and thus the repeated descriptions are omitted herein.

Figure 4:
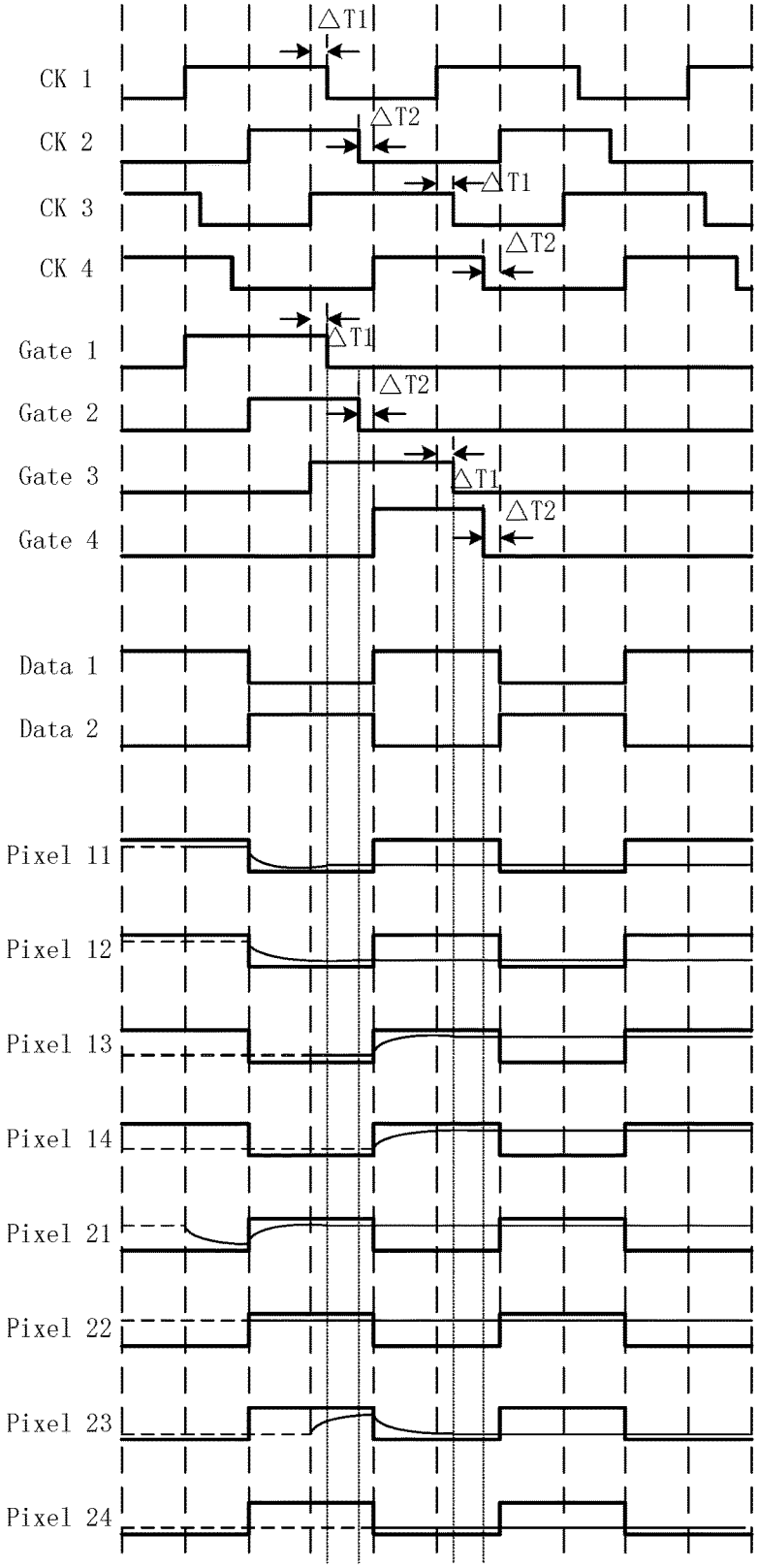
FIG. 4 is a schematic diagram of a clock signal, a gate driving signal and the charging voltage of the pixel units according to the third embodiment of the disclosure.

In conjunction with FIG. 1 and FIG. 4 FIG. 4 shows a schematic diagram of a clock signal, a gate driving signal and the charging voltage of the pixel units according to the third embodiment of the disclosure. In FIG. 4, the signal CK1 is the first clock signal received by the first driving stage 311, the signal CK2 is the second clock signal received by the second driving stage 312, the signal CK3 is the third clock signal received by the third driving stage 313, and the signal CK4 is the fourth clock signal received by the fourth driving stage 314. The periods of the signal CK1, the signal CK2, the signal CK3 and the signal CK4 are equal. The phase difference between the signal CK1 and the signal CK2, the phase difference between the signal CK2 and the signal CK3 and the phase difference between the signal CK3 and the signal CK4 are a quarter of the period. The signal Gate 1 is the first gate driving signal outputted by the first driving stage 311 to the scan line G1 according to the signal CK1. The signal Gate 2 is the second gate driving signal outputted by the second driving stage 312 to the scan line G2 according to the signal CK2. The signal Gate 3 is the third gate driving signal outputted by the third driving stage 313 to the scan line G3 according to the signal CK3. The signal Gate 4 is the fourth gate driving signal outputted by the fourth driving stage 314 to the scan line G4 according to the signal CK4. The periods of the signal Gate 1, the signal Gate 2, the signal Gate 3 and the signal Gate 4 are equal. The phase difference between the signal Gate 1 and the signal Gate 2, the phase difference between the signal Gate 2 and the signal Gate 3 and the phase difference between the signal Gate 3 and the signal Gate 4 are a quarter of the period. The Pixel 11 connected with the scan line G1 is driven by the signal Gate 1, the Pixel 12 connected with the scan line G2 is driven by the signal Gate 2, the Pixel 13 connected with the scan line G3 is driven by the signal Gate 3, and the Pixel 14 connected with the scan line G4 is driven by the signal Gate 4.

The pulse widths of the signal CK1 and the signal CK3 are equal, the pulse widths of the signal CK2 and the signal CK4 are equal, and the pulse widths of the signal CK1 and the signal CK3 are larger than the pulse widths of the signal CK2 and the signal CK4. The pulse width of the signal Gate 1 outputted according to the signal CK1 and the pulse width of the signal Gate 3 outputted according to the signal CK3 are equal, and the pulse width of the signal Gate 2 outputted according to the signal CK2 and the pulse width of the signal Gate 4 outputted according to the signal CK4 are equal. Thus, the pulse widths of the signal Gate 1 and the signal Gate 3 are larger than the pulse widths of the signal Gate 2 and the signal Gate 4. The larger the pulse width of the gate driving signal is, the longer the pixel units will be charged and the larger the charging amount of the pixel units will be. Therefore, compared with the Pixel 12 and the Pixel 14 respectively driven by the signal Gate 2 and signal Gate 4, the Pixel 11 and the Pixel 13 respectively driven by the signal Gate 1 and signal Gate 3 have a longer charging time.

In this embodiment, the pulse widths of the signal CK1 and the signal CK3 are enlarged and the pulse widths of the signal CK2 and the signal CK4 are shrunk so that the pulse widths of the signal CK1 and the signal CK3 are larger than the pulse widths of the signal CK2 and the signal CK4. In other embodiments, to make the pulse widths of the signal CK1 and the signal CK3 larger than the pulse widths of the signal CK2 and the signal CK4, the pulse widths of the signal CK2 and the signal CK4 can be shrunk, or the pulse widths of the signal CK1 and the signal CK3 can be enlarged.

The signal Data 1 is the data driving signal outputted by the data driving circuit 32 to the data line D1, and the signal Data 2 is the data driving signal outputted by the data driving circuit 32 to the data line D2. The period of the signal Data 1 and the period of the signal Data 2 are equal, but the polarity of the signal Data 1 and the polarity of the signal Data 2 are opposite.

As shown in FIG. 4, the Pixel 11 is driven by the signal Gate 1 and thus turned on before the polarity of the signal Data 1 is reversed. When the Pixel 11 is turned on, due to the signal Data 1, the Pixel 11 receives a signal at high level for charging within the former quarter of the period, and receives a signal at low level for charging within the later quarter of the period. Thus, during the time when the Pixel 11 is charged, the polarity of the Pixel 11 is reversed such that the Pixel 11 is not fully charged. The Pixel 12 is driven by the signal Gate 2 and thus turned on after the polarity of the signal Data 1 is reversed. During the time when the Pixel 12 is charged, the Pixel 12 always receives a signal at low level for charging, so the polarity of the Pixel 12 will not be reversed and thus the Pixel 12 is fully charged. However, the pulse width of the signal Gate 1 is larger, so the Pixel 11 can be charged for a longer time after its polarity is reversed and thus the Pixel 11 can be charged more. On the other hand, the pulse width of the signal Gate 2 is smaller, so the Pixel 12 will be charged for a shorter time and thus the Pixel 12 will be charged less. As a result, the difference between the charging amount of the Pixel 11 and the charging amount of the Pixel 12 can be small.

Likewise, the Pixel 13 is driven by the signal Gate 3 and thus turned on before the polarity of the signal Data 1 is reversed. When the Pixel 13 is turned on, due to the signal Data 1, the Pixel 13 receives a signal at low level for charging within the former quarter of the period, and receives a signal at high level for charging within the later quarter of the period. Thus, during the time when the Pixel 13 is charged, the polarity of the Pixel 13 is reversed such that the Pixel 13 is not fully charged. The Pixel 14 is driven by the signal Gate 4 and thus turned on after the polarity of the signal Data 1 is reversed. During the time when the Pixel 14 is charged, the Pixel 14 always receives a signal at high level for charging, so the polarity of the Pixel 14 will not be reversed and thus the Pixel 14 is fully charged.

However, the pulse width of the signal Gate 3 is larger, so the Pixel 13 can be charged for a longer time after its polarity is reversed and thus the Pixel 13 can be charged more. On the other hand, the pulse width of the signal Gate 4 is smaller, so the Pixel 14 will be charged for a shorter time and thus the Pixel 14 will be charged less. As a result, the difference between the charging amount of the Pixel 13 and the charging amount of the Pixel 14 can be small.

The working principles relevant to how the Pixel 21, the Pixel 22, the Pixel 23 and the Pixel 24 are charged are similar to the above working principles relevant to how the Pixel 11, the Pixel 12, the Pixel 13 and the Pixel 14 are charged, and thus the repeated descriptions are omitted herein.

In other embodiments, the gate driving circuit 31 can have six, eight or more driving stages as long as the number of the driving stages is an even.

According to the above, in this embodiment, by enlarging the pulse width of the gate driving signal of those pixel units of which the polarity will be revered during their charging process, those pixel units can be charged for a longer time. Thus, a difference between the charging amount of those pixel units of which the polarity will be revered during their charging process and the charging amount of those pixel units of which the polarity will not be revered during their charging process will be small, such that the brightness variation of the liquid crystal display can be reduced and thus the liquid crystal display can have a better display performance.

In this disclosure, the driving abilities of the gate driving signals provided to two scan lines corresponding to the pixel units in the same column are different, so the difference between the charging amount of those pixel units of which the polarity will be revered during their charging process and the charging amount of those pixel units of which the polarity will not be revered during their charging process will be small, such that the brightness variation of the liquid crystal display can be reduced and thus the liquid crystal display can have a better display performance.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A liquid crystal display panel, comprising:

a plurality of pixel units, arranged in a matrix;

a plurality of scan lines, wherein every two scan lines are corresponded to the pixel units in the same row and alternatively connected to the pixel units in the same row;

a gate driving circuit, configured to provide a gate driving signal sequentially to each scan line to turn on the pixel units connected with each scan line;

a plurality of data lines, wherein the data lines are configured respectively between the pixel units in every two columns, and each data line is connected to the pixel units in the columns and;

a data driving circuit, configured to provide a data driving signal to each data line by reversing the polarity of the data driving signal to charge the turned-on pixel units connected with each data line, wherein the pixel units connected with a first one of the scan lines corresponding to the pixel units in the same row are turned on before the polarity of the data driving signal is reversed, the pixel units connected with a second one of the scan lines corresponding to the pixel units in the same row are turned on when or after the polarity of the data driving signal is reversed, the driving ability of the gate driving signal provided to the first one of the scan lines is larger than the driving ability of the gate driving signal provided to the second one of the scan lines such that the charging variation caused by reversing the polarity of the data driving signal is cancelled, and wherein the phase difference between the gate driving signals provided to every two adjacent scan lines is a quarter of the period of the polarity reversion of the data driving signal;

the gate driving circuit comprises a first driving stage, receiving a first clock signal and accordingly outputting a first gate driving signal;

a second driving stage, receiving a second clock signal and accordingly outputting a second gate driving signal;

a third driving stage, receiving a third clock signal and accordingly outputting a third gate driving signal; and a fourth driving stage, receiving a fourth clock signal and accordingly outputting a fourth gate driving signal, wherein the driving abilities of the first gate driving signal and the second gate driving signal are different due to the first clock signal and the second clock signal, the driving abilities of the third gate driving signal and the first gate driving signal are equal due to the third clock signal and the first clock signal, and the driving abilities of the fourth gate driving signal and the second gate driving signal are equal.

2. The liquid crystal display panel according to claim 1, wherein the pulse width of the gate driving signal provided to the first one of the scan lines is larger than the pulse width of the gate driving signal provided to the second one of the scan lines.

3. The liquid crystal display panel according to claim 1, wherein the gate driving circuit is configured at one side of the liquid crystal display panel.

4. The liquid crystal display panel according to claim 1, wherein the data driving circuit is configured at one side of the liquid crystal display panel.

5. The liquid crystal display panel according to claim 1, wherein the scan lines are respectively perpendicular to the data lines.

6. A liquid crystal display panel, comprising:

a plurality of pixel units, arranged in a matrix;

a plurality of scan lines, wherein every two scan lines are corresponded to the pixel units in the same row and alternatively connected to the pixel units in the same row;

a gate driving circuit, configured to provide a gate driving signal sequentially to each scan line to turn on the pixel units connected with each scan line;

a plurality of data lines, wherein the data lines are configured respectively between the pixel units in every two columns, and each data line is connected to the pixel units in the two columns and;

a data driving circuit, configured to provide a data driving signal to each data line by reversing the polarity of the data driving signal to charge the turned-on pixel units connected with each data line, wherein the driving abilities of the gate driving signals provided to the two scan lines corresponding to the pixel units in the same row are different such that the charging variation caused by reversing the polarity of the data driving signal is cancelled;

the gate driving circuit comprises a first driving stage, receiving a first clock signal and accordingly outputting a first gate driving signal;

a second driving stage, receiving a second clock signal and accordingly outputting a second gate driving signal;

a third driving stage, receiving a third clock signal and accordingly outputting a third gate driving signal; and a fourth driving stage, receiving a fourth clock signal and accordingly outputting a fourth gate driving signal, wherein the driving abilities of the first gate driving signal and the second gate driving signal are different due to the first clock signal and the second clock signal, the driving abilities of the third gate driving signal and the first gate driving signal are equal due to the third clock signal and the first clock signal, and the driving abilities of the fourth gate driving signal and the second gate driving signal are equal.

7. The liquid crystal display panel according to claim 6, wherein the pixel units connected with a first one of the scan lines corresponding to the pixel units in the same row are turned on before the polarity of the data driving signal is reversed, the pixel units connected with a second one of the scan lines corresponding to the pixel units in the same column are turned on when or after the polarity of the data driving signal is reversed, and the driving ability of the gate driving signal provided to the first one of the scan lines is larger than the driving ability of the gate driving signal provided to the second one of the scan lines.

8. The liquid crystal display panel according to claim 7, wherein the pulse width of the gate driving signal provided to the first one of the scan lines is larger than the pulse width of the gate driving signal provided to the second one of the scan lines.

9. The liquid crystal display panel according to claim 6, wherein the phase difference between the gate driving signals provided to every two adjacent scan lines is a quarter of the period of the polarity reversion of the data driving signal.

10. The liquid crystal display panel according to claim 6, wherein the gate driving circuit is configured at one side of the liquid crystal display panel.

11. The liquid crystal display panel according to claim 6, wherein the data driving circuit is configured to one side of the liquid crystal display panel.

12. The liquid crystal display panel according to claim 6, wherein the scan lines are respectively perpendicular to the data lines.

13. A gate driving circuit, configured in a liquid crystal display panel, comprising:

a first driving stage, receiving a first clock signal and accordingly outputting a first gate driving signal; and a second driving stage, receiving a second clock signal and accordingly outputting a second gate driving signal;

a third driving stage, receiving a third clock signal and accordingly outputting a third gate driving signal; and a fourth driving stage, receiving a fourth clock signal and accordingly outputting a fourth gate driving signal, wherein the driving abilities of the first gate driving signal and the second gate driving signal are different due to the first clock signal and the second clock signal, the driving abilities of the third gate driving signal and the first gate driving signal are equal due to the third clock signal and the first clock signal, and the driving abilities of the fourth gate driving signal and the second gate driving signal are equal.

14. The gate driving circuit according to claim 13, wherein the pulse width of the first clock signal is larger than the pulse width of the second clock signal, such that the pulse width of the first gate driving signal is larger than the pulse width of the second gate driving signal.

15. The gate driving circuit according to claim 13, wherein the periods of the first clock signal, the second clock signal, the third clock signal and the fourth clock signal are equal, the phase difference between the first clock signal and the second clock signal, the phase difference between the second clock signal and the third clock signal and the phase difference between the third clock signal and the fourth clock signal are a quarter of the period, such that the periods of the first gate driving signal, the second gate driving signal, the third gate driving signal and the fourth gate driving signal are equal, and the phase difference between the first gate driving signal and the second gate driving signal, the phase difference between the second gate driving signal and the third gate driving signal and the phase difference between the third gate driving signal and the fourth gate driving signal are a quarter of the period.

* * * * *